US007753617B1

(12) United States Patent
Corr

(10) Patent No.: US 7,753,617 B1
(45) Date of Patent: Jul. 13, 2010

(54) UTILITY COVER SYSTEM

(76) Inventor: Robert F. Corr, 9006 Butler Rd., Sauquoit, NY (US) 13456

( * ) Notice: Subject to any disclaimer, the term of this patent is extended or adjusted under 35 U.S.C. 154(b) by 0 days.

(21) Appl. No.: 12/030,342

(22) Filed: Feb. 13, 2008

Related U.S. Application Data

(62) Division of application No. 11/283,126, filed on Nov. 18, 2005, now Pat. No. 7,354,220, which is a division of application No. 10/460,080, filed on Jun. 11, 2003, now Pat. No. 6,994,489.

(51) Int. Cl.
*E02D 29/14* (2006.01)

(52) U.S. Cl. ..... 404/25; 137/371

(58) Field of Classification Search ..... 404/25, 404/26; 52/20; 137/371
See application file for complete search history.

(56) References Cited

U.S. PATENT DOCUMENTS 3,921,449 A * 11/1975 Hauffe et al. ..... 73/273
4,614,065 A * 9/1986 Papp ..... 52/20
4,925,336 A * 5/1990 Simmonds ..... 404/25
4,973,191 A * 11/1990 Dannhauser ..... 404/25
5,030,030 A * 7/1991 Simmonds ..... 404/25
5,375,940 A * 12/1994 Kobayashi ..... 404/2
5,536,110 A * 7/1996 Tompkins et al. ..... 404/25
5,944,442 A * 8/1999 Roush et al. ..... 404/26
6,769,834 B1 * 8/2004 Stange ..... 404/25
6,994,489 B1 * 2/2006 Corr ..... 404/25
7,354,220 B1 * 4/2008 Corr ..... 404/73

* cited by examiner

*Primary Examiner*—Gary S Hartmann
(74) *Attorney, Agent, or Firm*—Luedeka, Neely & Graham, P.C.

(57) ABSTRACT

A utility cover system which includes an outer frame having an opening defined by an inner tapered edge, and a wedge cover plate formed of a resilient material having an outer tapered edge that fits within the opening of the outer frame. The outer frame preferably has an inner segment and an outer segment, wherein the outer segment is thinner than the inner segment. The cover plate is sufficiently flexible to be removably positionable into engagement with the outer frame by passing through the outer frame opening.

3 Claims, 7 Drawing Sheets

UTILITY COVER SYSTEM

This application is a Divisional of application Ser. No. 11/283,126 filed Nov. 18, 2005 now U.S. Pat. No. 7,354,220, which is a Divisional of application Ser. No. 10/460,080 filed Jun. 11, 2003, now U.S. Pat. No. 6,994,489).

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to utility access structures positioned within asphalt or concrete roads and more specifically it relates to a utility cover system for preventing water leakage into a utility access structure within a road surface and for eliminating the need for expensive adjustment structures.

2. Description of the Related Art

Utility access structures have been in use for years for various utilizes such as utility valves (e.g. valve covers), sewers (e.g. manholes) and catch basins. The utility access structures typically have a housing structure positioned within the road surface with a cover removably attached thereto. The housing structure and the cover are typically comprised of a hard material such as metal.

One of the problems with conventional utility access structures is that they allow surface water to flow into the access structures thereby damaging the components within the access structure. Another problem is that when an asphalt road is resurfaced, an upper portion of the asphalt may be ground off which can cause damage to the access structure. In addition, it is often times required that workers manually remove the asphalt surrounding the access structure which is labor intensive and time consuming. To solve the resurfacing problem, adjustable structures (e.g. adjustment rings, etc.) have been created but they are extremely expensive and noisy for surrounding residents.

Examples of patented devices which may be related to the present invention include U.S. Pat. No. 5,536,110 to Tompkins et al.; U.S. Pat. No. 6,196,760 to Sinclair; U.S. Pat. No. 5,723,192 to Jonasz; U.S. Pat. No. 4,368,893 to Gagas; U.S. Pat. No. 5,564,855 to Anderson; U.S. Pat. No. 5,876,533 to House et al.; U.S. Pat. No. 6,179,518 to Suatac; U.S. Pat. No. 4,469,467 to Odill et al.; U.S. Pat. No. 5,299,884 to Westhoff et al.; U.S. Pat. No. 3,858,998 to Larsson et al.; U.S. Pat. No. 4,145,151 to Helms; U.S. Pat. No. 4,540,310 to Ditcher et al.; and U.S. Pat. No. 387,181 to Sinclair.

While these devices may be suitable for the particular purpose to which they address, they are not as suitable for preventing water leakage into a utility entrance within a road surface and for eliminating the need for expensive adjustment structures. Conventional utility access structures are prone to water leakage and interfere with road resurfacing.

In these respects, the utility cover system according to the present invention substantially departs from the conventional concepts and designs of the prior art, and in so doing provides an apparatus primarily developed for the purpose of preventing water leakage into a utility entrance within a road surface and for eliminating the need for expensive adjustment structures.

BRIEF SUMMARY OF THE INVENTION

In view of the foregoing disadvantages inherent in the known types of utility access structures now present in the prior art, the present invention provides a new utility cover system construction wherein the same can be utilized for preventing water leakage into a utility entrance within a road surface and for eliminating the need for expensive adjustment structures.

To attain this, the present invention generally comprises an outer frame having an opening defined by an inner tapered edge, and a wedge cover having an outer tapered edge that fits within the opening of the outer frame. The outer frame preferably has an inner segment and an outer segment, wherein the outer segment is thinner than the inner segment.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a utility cover system that will overcome the shortcomings of the prior art devices.

A second object is to provide a utility cover system for preventing water leakage into a utility entrance within a road surface and for eliminating the need for expensive adjustment structures.

Another object is to provide a utility cover system that is rugged, flexible, lightweight, inexpensive and easy to handle.

An additional object is to provide a utility cover system that provides a watertight seal about a utility access structure.

A further object is to provide a utility cover system that absorbs vehicle impact and disperses vehicle weight thereby reducing damage to the utility access structure.

Another object is to provide a utility cover system that can be ground with the asphalt during a road-resurfacing project thereby reducing the amount of time and labor required to resurface a road.

A further object is to provide a utility cover system that may be stacked to various heights to adjust for differing road surface depths.

Another object is to provide a utility cover system that may be utilized with various types, sizes and shapes of utility access structures.

A further object is to provide a utility cover system that still allows for complete and unobstructed access to the utility without hardware installation.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
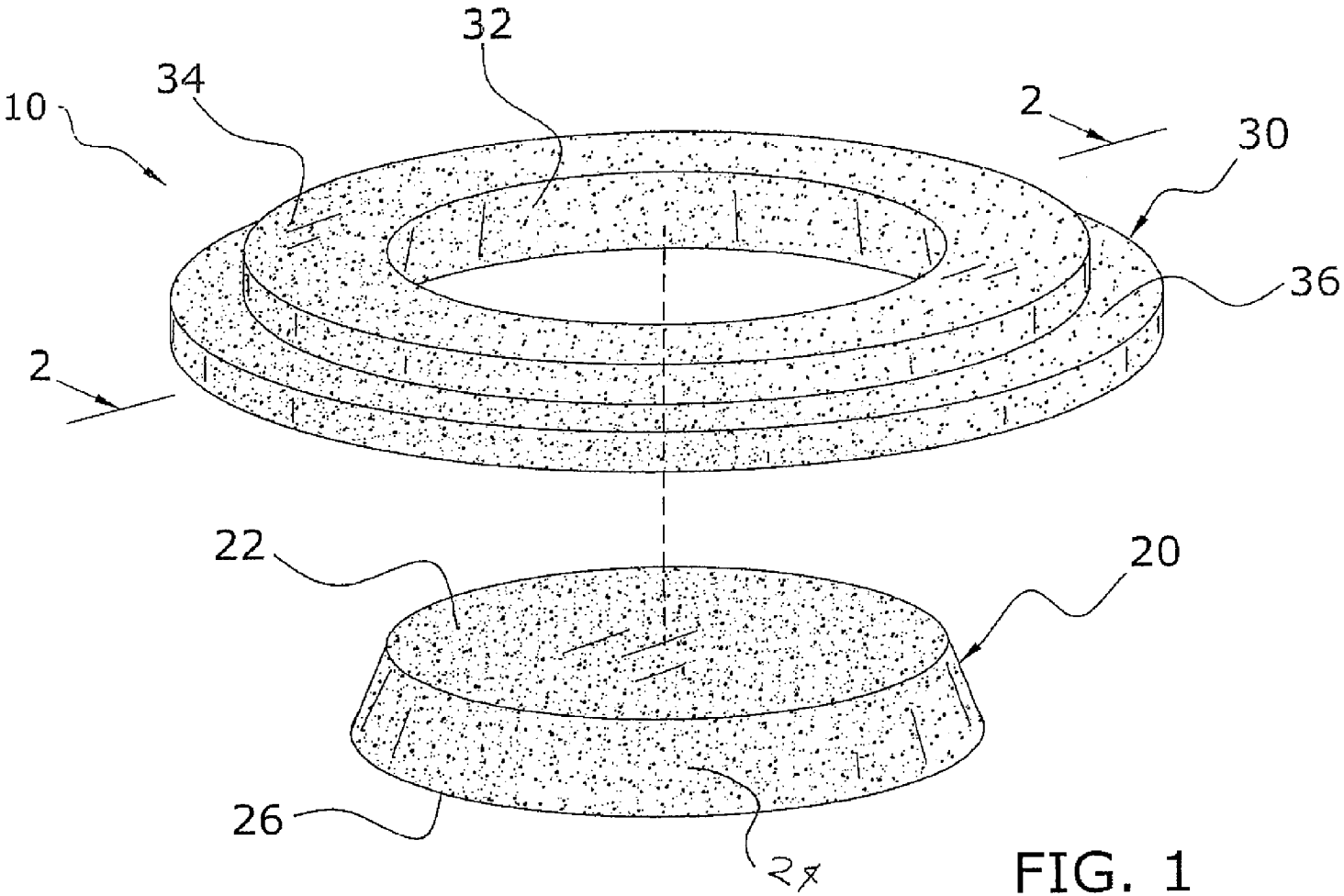
FIG. 1 is an exploded upper perspective view of the present invention.

Turning now descriptively to the drawings, in which similar reference characters denote similar elements throughout the several views, FIGS. 1 through 7 illustrate a utility cover system 10, which comprises an outer frame 30 having an opening defined by an inner tapered edge 32, and a wedge cover 20 having an outer tapered edge 24 that fits within the opening of the outer frame 30. The outer frame 30 preferably has an inner segment 34 and an outer segment 36, wherein the outer segment 36 is thinner than the inner segment 34.

B. Outer Frame

Figure 3:
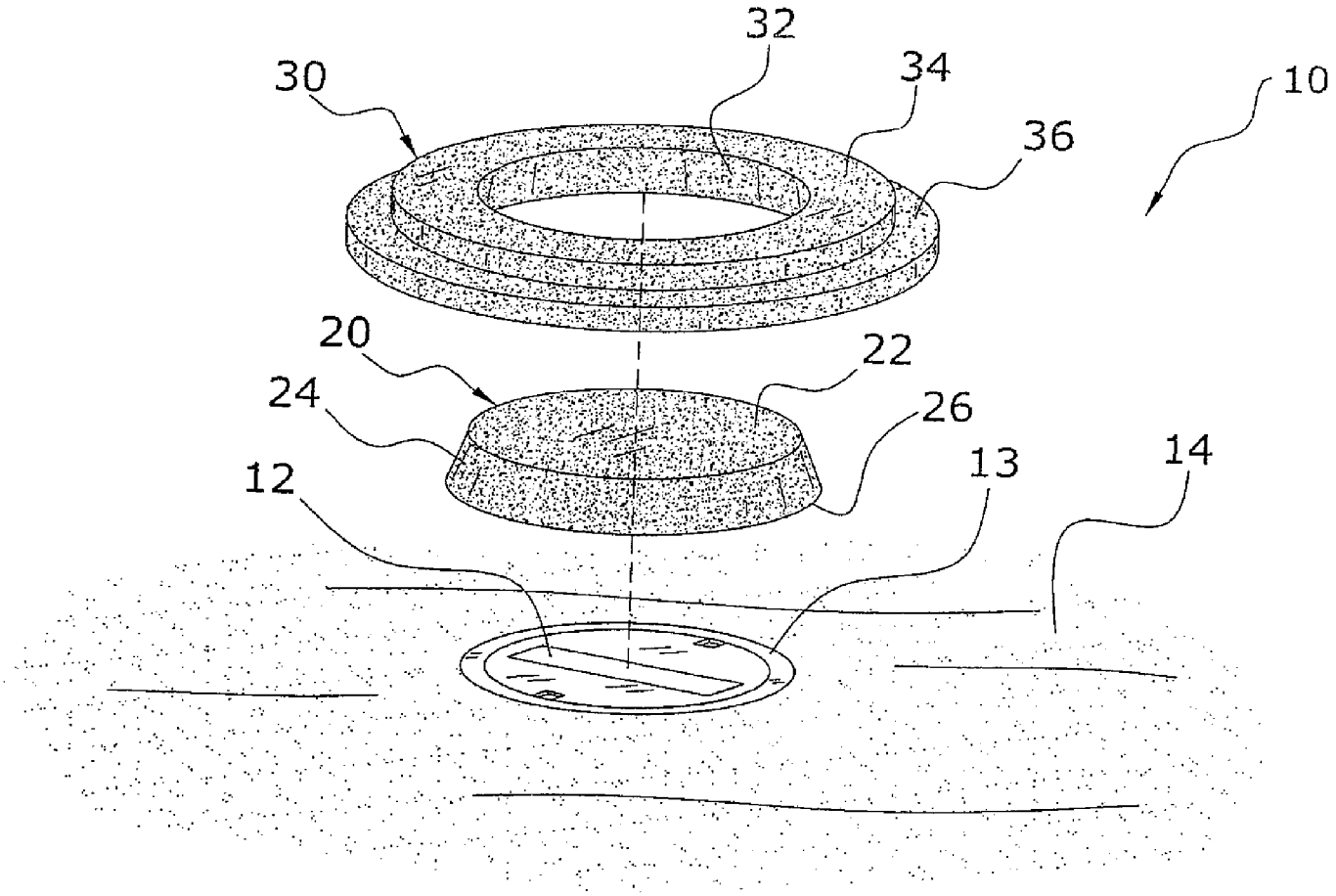
FIG. 3 is an exploded upper perspective view of the present with respect to a utility access structure with the existing road surface.

The outer frame 30 has an opening defined by an inner tapered edge 32 as best illustrated in FIGS. 1 and 3 of the drawings. The outer frame 30 may have various shapes such as but not limited to rectangular, circular and the like. The outer frame 30 preferably has an inner segment 34 and an outer segment 36 as shown in FIGS. 1 and 3 of the drawings.

The outer frame 30 is preferably comprised of a resilient and flexible material such as rubber and the like. However, the outer frame 30 may be comprised of a rigid structure.

Figure 2:
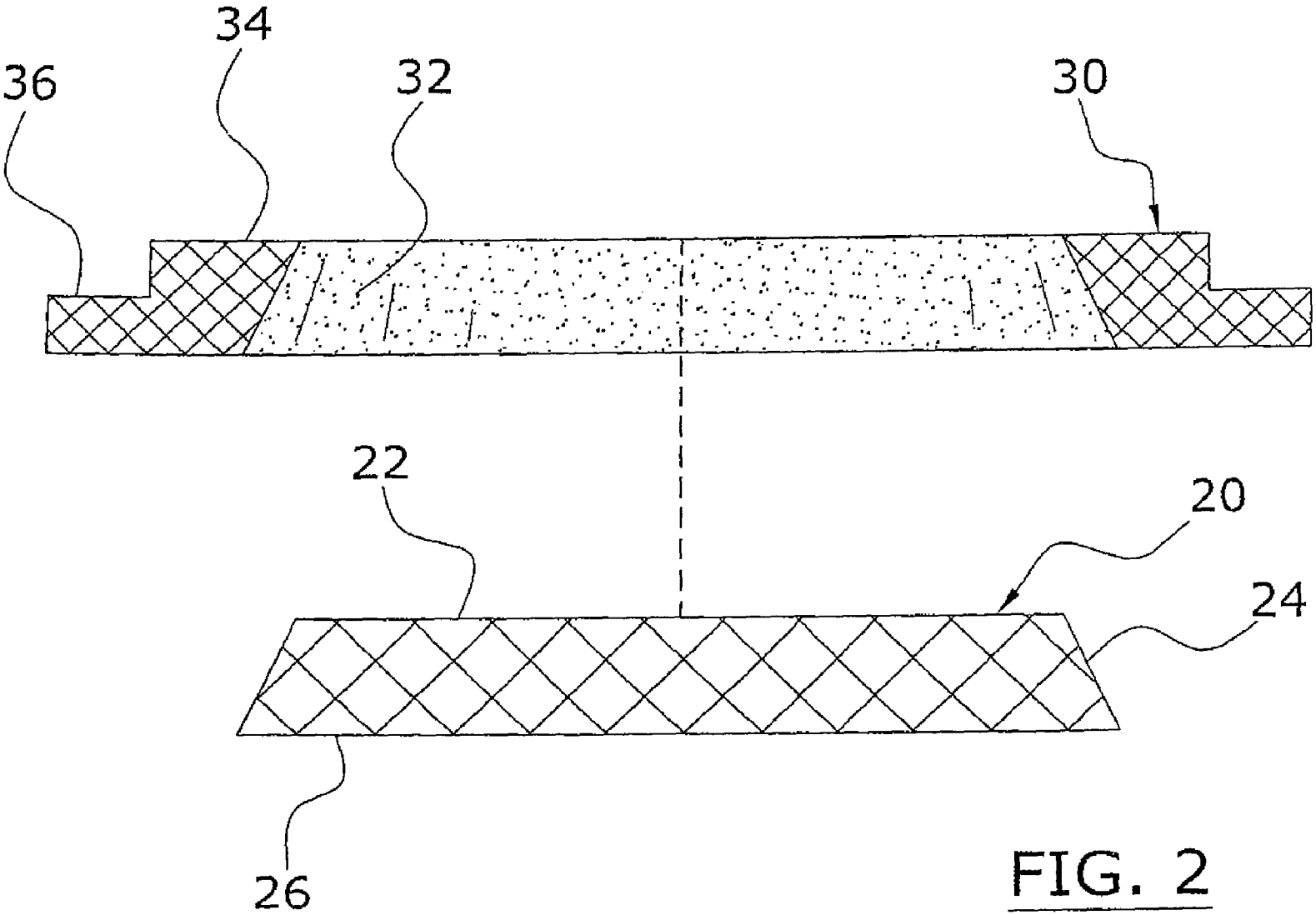
FIG. 2 is a cross sectional view taken along line 2-2 of FIG. 1.
Figure 6:
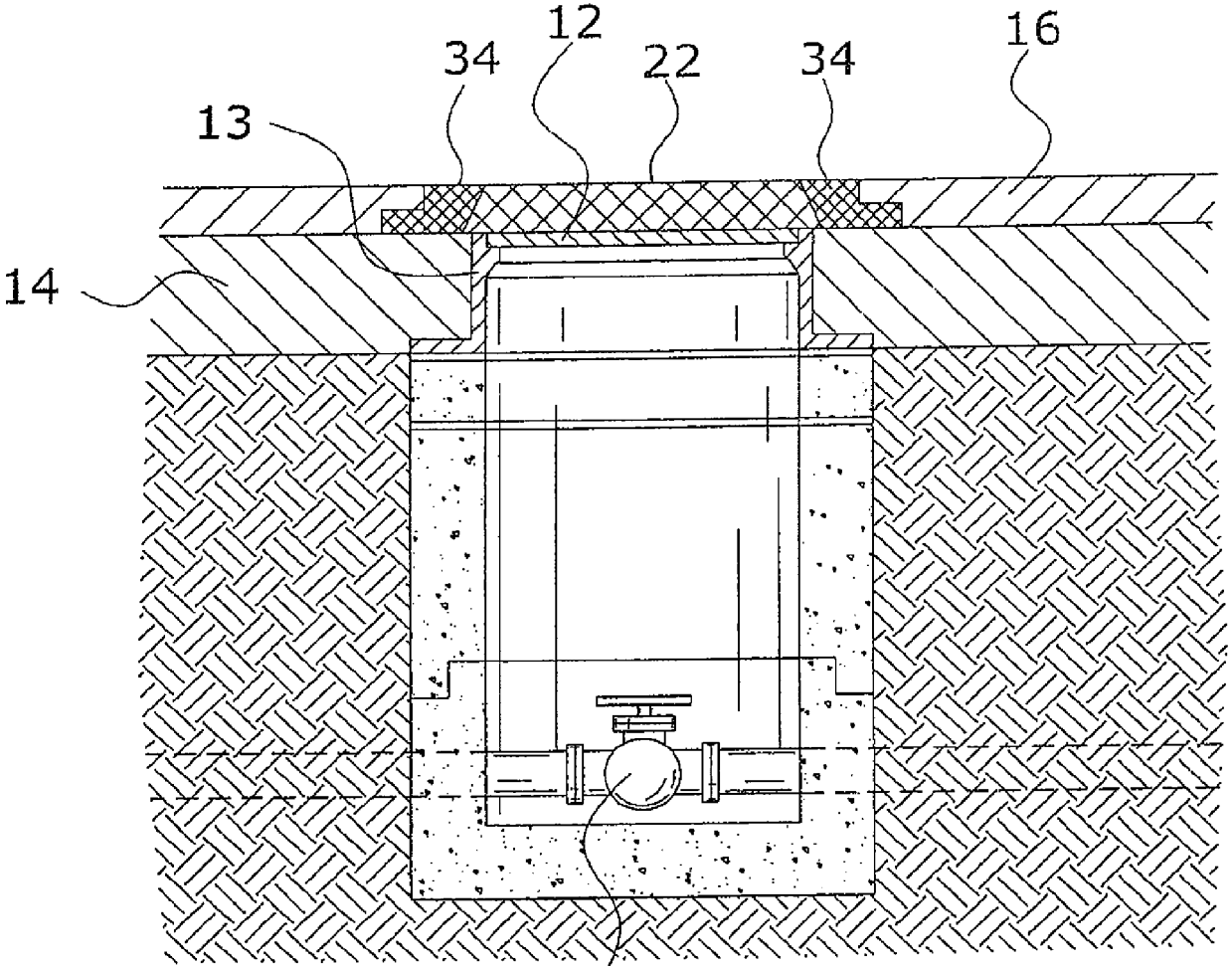
FIG. 6 is a side cutaway view of the present invention positioned about a utility access structure in a sealed manner.
Figure 7:
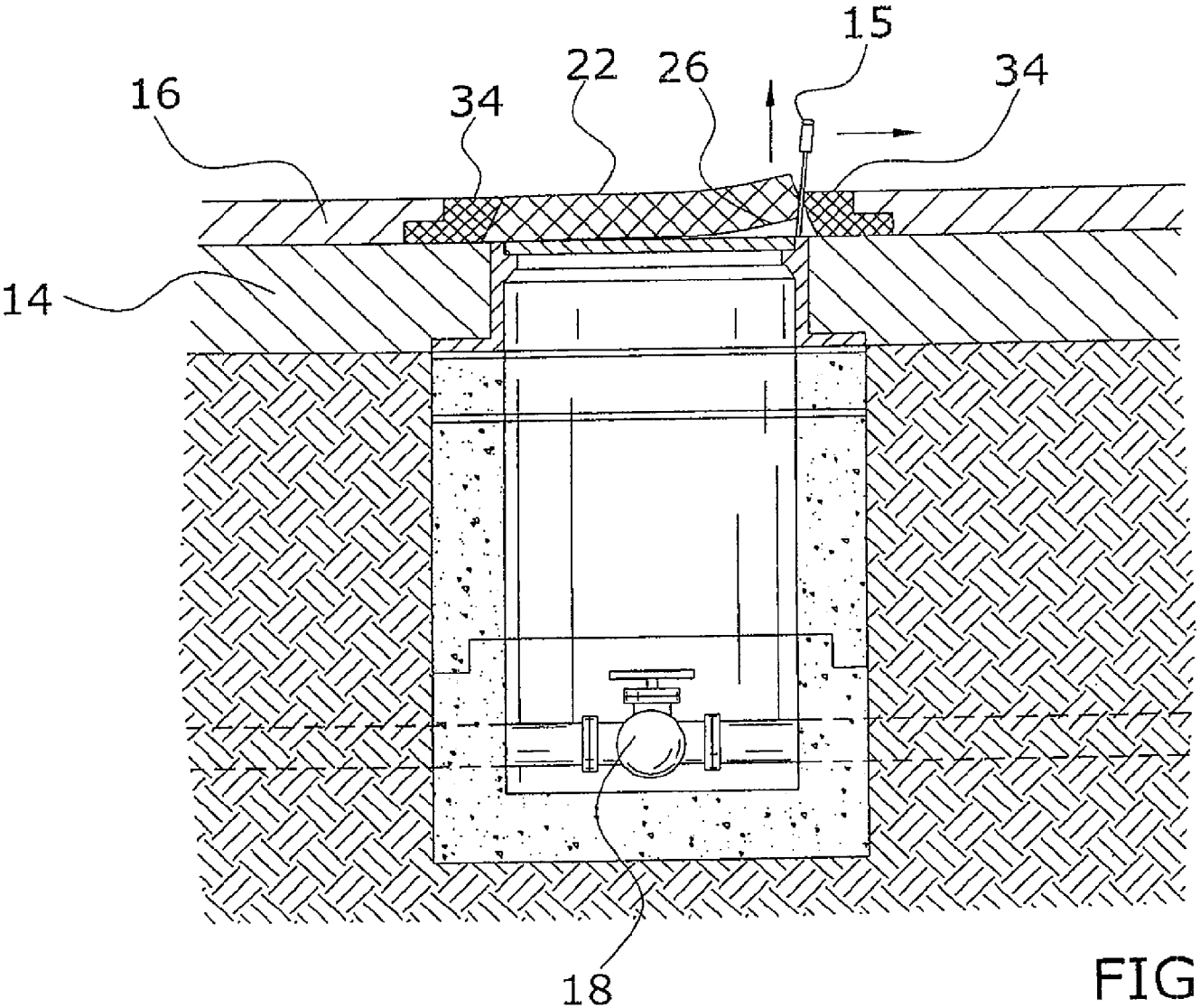
FIG. 7 is a side cutaway view of the present invention with the wedge cover being partially removed with a tool.

The outer segment 36 preferably is thinner than the inner segment 34 forming a stepped structure as best illustrated in FIG. 2 of the drawings. The inner segment 34 and the outer segment 36 preferably have a common lower portion as further shown in FIG. 2 of the drawings. The lower portion of the outer segment 36 is preferably positioned upon the old road surface 14, wherein the old road surface 14 may have been ground to a lowered level through resurfacing procedures. The lower portion of the outer frame 30 is preferably attached and sealed utilizing an adhesive or other bonding agent. The outer segment 36 of the outer frame 30 is utilized for receiving the new road surface 16 applied over the old road surface 14 as shown in FIGS. 6 and 7 of the drawings.

As shown in FIG. 2 of the drawings, the inner tapered edge 32 tapers inwardly and upwardly. The inner tapered edge 32 may have an angled structure, curved structure or other shaped structure. The wedge cover 20 is formed to preferably snugly fit within the opening within the outer frame 30.

C. Wedge Cover

The wedge cover 20 has an outer tapered edge 24 that corresponds to the inner tapered edge 32 of the outer frame 30 as shown in FIGS. 1 through 3 of the drawings. The wedge cover 20 may have various shapes such as but not limited to rectangular, circular and the like. However, the wedge cover 20 is preferably formed to a shape and size similar to the opening within the outer frame 30.

The wedge cover 20 is preferably comprised of a resilient and flexible material such as rubber and the like. The flexibility of the wedge cover 20 allows it to be removed from the outer frame 30 by prying with a tool 15 or other device.

As shown in FIG. 2 of the drawings, the outer tapered edge 24 preferably tapers inwardly and upwardly corresponding to the inner tapered edge 32. The wedge cover 20 is removably positionable within the opening of the outer frame 30 as best shown in FIGS. 6 and 7 of the drawings.

Figure 4:
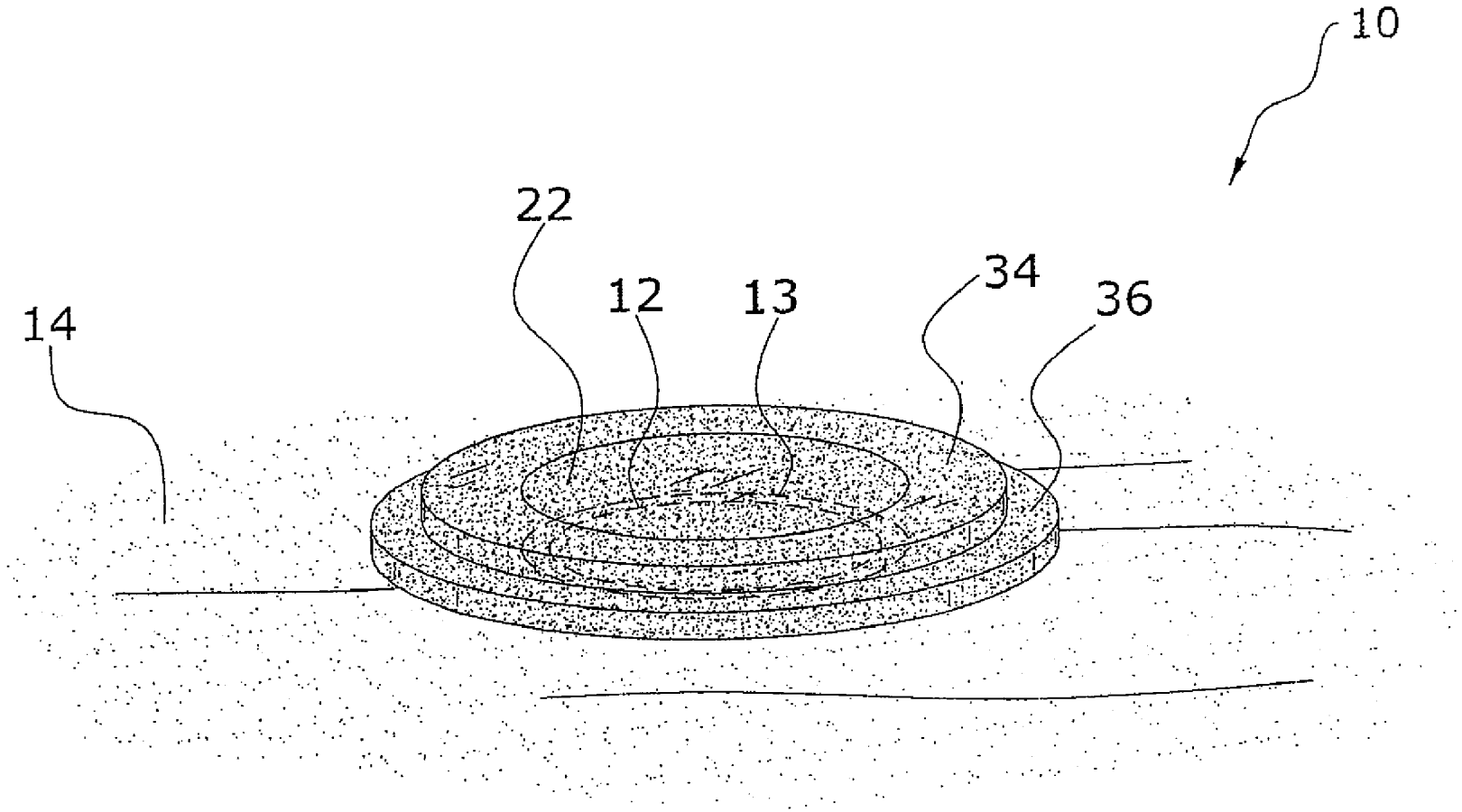
FIG. 4 is an upper perspective view of the present invention positioned about the utility access structure and upon the existing road surface.
Figure 5:
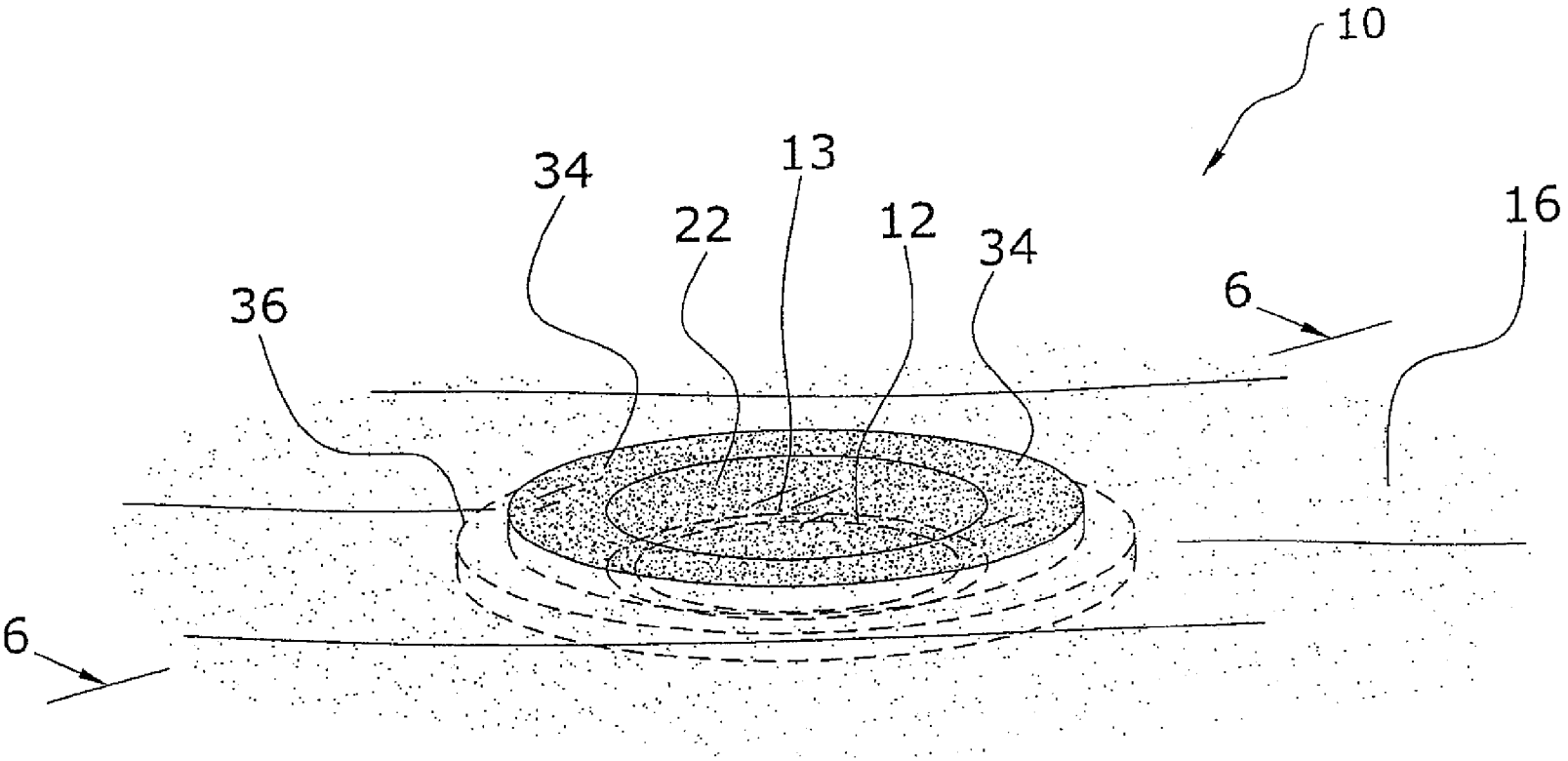
FIG. 5 is an upper perspective view of the present invention partially surrounding by a new road surface.

As shown in FIGS. 1 and 3 of the drawings, the wedge cover 20 has a bottom surface 26 that is positionable over a utility cover 12. The wedge cover 20 further has an upper surface 22 that is substantially parallel to an upper portion of the outer frame 30 when positioned within the outer frame 30 as shown in FIGS. 4 through 6 of the drawings.

As shown in FIGS. 1 and 2 of the drawings, the opening and the wedge cover 20 preferably have a similar shape. The wedge cover 20 is preferably positionable in a sealable manner within the opening of the outer frame 30 to prevent water and other debris from entering the utility housing 13 thereby protecting the utility such as a valve 18.

D. Operation

In use, the user first positions the outer frame 30 about a utility cover 12 of the utility access structure. The user preferably secures and seals the outer frame 30 to the old road surface 14 surrounding the utility housing 13 of the utility access structure. After the outer frame 30 is fully secured, the user then positions the wedge cover 20 within the opening of the outer frame 30 defined by the inner tapered edge 32 as shown in FIG. 4 of the drawings. It can be appreciated that the wedge cover 20 may be first positioned adjacent to the utility cover 12 prior to or simultaneously with the application of the outer frame 30. A layer of new road surface 16 is positioned upon the outer segment 36 and substantially flush with the inner segment 34 as shown in FIG. 5 of the drawings. If required, the present invention may be stacked to achieve various heights. If an individual desires to access the utility access structure, they simply insert a tool 15 between the wedge cover 20 and the outer frame 30 thereafter prying the wedge cover 20 from the outer frame 30 as shown in FIG. 7 of the drawings. The individual may then access the utility by removing the utility cover 12 and perform the desired procedures. When finished, the utility cover 12 is returned to the utility housing 13 and the wedge cover 20 is repositioned in a sealed manner within the opening of the outer frame 30. If the road is to resurfaced in the future, the outer frame 30 and the wedge cover 20 may remain during the grinding of the road surface and may be ground along with the asphalt.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A utility cover system for covering an access cover to an underground utility chamber existing beneath the surface of a roadway to be resurfaced, comprising:

an outer frame positioned about an access cover to an underground utility chamber existing beneath the surface of a roadway to be resurfaced;

said outer frame being secured to said roadway surface such that said outer frame height is flush with the resurfaced roadway surface;

said outer frame having an opening therethrough defined by an edge for receiving a cover plate having a mating edge;

said edge of said outer frame opening having an inner diameter less than an outer diameter of said cover plate mating edge;

a cover plate for covering the access cover and having an outer edge diameter greater than the inner diameter of said outer frame opening edge to engage with said outer frame edge;

said cover plate being formed of a resilient material and having a thickness such that upon said edges engaging with each other an upper surface of said cover plate will be flush with an upper surface of said outer frame; and said cover plate being sufficiently flexible to be removably positioned into engagement with said outer frame edge by passing said cover plate through said outer frame opening.

2. The utility covering system of claim 1 wherein said upper surface of said outer frame is formed on an inner segment thereof positioned flush with the resurfaced roadway, and said outer frame further includes an outer segment positioned on the roadway to be resurfaced for securing said outer frame thereto.

3. The utility covering system of claim 2 wherein said outer frame is formed from a resilient material.

* * * * *